US010947829B2

(12) United States Patent
Oehring

(10) Patent No.: US 10,947,829 B2
(45) **Date of Patent: *Mar. 16, 2021**

(54) CABLE MANAGEMENT OF ELECTRIC POWERED HYDRAULIC FRACTURING PUMP UNIT

(71) Applicant: U.S. Well Services, LLC, Houston, TX (US)

(72) Inventor: Jared Oehring, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 106 days.

This patent is subject to a terminal disclaimer.

(21) Appl. No.: 16/047,653

(22) Filed: Jul. 27, 2018

(65) Prior Publication Data

US 2018/0334893 A1 Nov. 22, 2018

Related U.S. Application Data

(63) Continuation of application No. 15/145,491, filed on May 3, 2016, now Pat. No. 10,036,238, which is a continuation-in-part of application No. 13/679,689, filed on Nov. 16, 2012, now Pat. No. 9,410,410.

(60) Provisional application No. 62/156,303, filed on May 3, 2015.

(51) Int. Cl.

| | |
|---|---|
| ***E21B 43/26*** | (2006.01) |
| ***F04B 23/04*** | (2006.01) |
| ***F04B 47/06*** | (2006.01) |

(52) U.S. Cl.

CPC ..... *E21B 43/26* (2013.01); *F04B 23/04* (2013.01); *F04B 47/06* (2013.01)

(58) Field of Classification Search

CPC ..... E21B 43/26

See application file for complete search history.

(56) References Cited

U.S. PATENT DOCUMENTS

| | | | |
|---|---|---|---|
| 1,656,861 | A | 1/1928 | Leonard |
| 1,671,436 | A | 5/1928 | Melott |
| 2,004,077 | A | 6/1935 | McCartney |
| 2,183,364 | A | 12/1939 | Bailey |
| 2,220,622 | A | 11/1940 | Aitken |

(Continued)

FOREIGN PATENT DOCUMENTS

| | | |
|---|---|---|
| AU | 2007340913 | 7/2008 |
| CA | 2406801 | 11/2001 |

(Continued)

OTHER PUBLICATIONS

Office Action dated Dec. 12, 2018 in related U.S. Appl. No. 16/160,708.

(Continued)

*Primary Examiner* — Kenneth L Thompson

(74) *Attorney, Agent, or Firm* — Hogan Lovells US LLP

(57) ABSTRACT

A hydraulic fracturing system includes a pump, an electrically powered motor for driving the pump, a trailer on which the pump and motor are mounted, and a transformer that steps down electricity for use by the motor. Electrical output from the transformer connects to a series of receptacles mounted onto a housing around the transformer. A similar set of receptacles is provided on the trailer and which are electrically connected to the motor. Power cables equipped with plugs on their opposing ends insert into the receptacles to close an electrical circuit between the transformer and pump.

15 Claims, 8 Drawing Sheets

(56) References Cited

U.S. PATENT DOCUMENTS 2,248,051 A 7/1941 Armstrong
2,407,796 A 9/1946 Page
2,416,848 A 3/1947 Rothery
2,610,741 A 9/1952 Schmid
2,753,940 A 7/1956 Bonner
3,055,682 A 9/1962 Bacher
3,061,039 A 10/1962 Peters
3,066,503 A 12/1962 Fleming
3,302,069 A 1/1967 Webster
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,881,551 A 5/1975 Terry
4,037,431 A 7/1977 Sugimoto
4,100,822 A 7/1978 Rosman
4,151,575 A 4/1979 Hogue
4,226,299 A 10/1980 Hansen
4,265,266 A 5/1981 Kierbow et al.
4,432,064 A 2/1984 Barker
4,442,665 A 4/1984 Fick et al.
4,456,092 A 6/1984 Kubozuka
4,506,982 A 3/1985 Smithers et al.
4,512,387 A 4/1985 Rodriguez
4,529,887 A 7/1985 Johnson
4,538,916 A 9/1985 Zimmerman
4,676,063 A 6/1987 Goebel et al.
4,759,674 A 7/1988 Schroder
4,793,386 A 12/1988 Sloan
4,845,981 A 7/1989 Pearson
4,922,463 A 5/1990 Del Zotto et al.
5,004,400 A 4/1991 Handke
5,006,044 A 4/1991 Walker, Sr.
5,025,861 A 6/1991 Huber
5,050,673 A 9/1991 Baldridge
5,130,628 A 7/1992 Owen
5,131,472 A 7/1992 Dees et al.
5,172,009 A 12/1992 Mohan
5,189,388 A 2/1993 Mosley
5,230,366 A 7/1993 Marandi
5,366,324 A 11/1994 Arlt
5,422,550 A 6/1995 McClanahan
5,433,243 A 7/1995 Griswold
5,517,822 A 5/1996 Haws et al.
5,548,093 A 8/1996 Sato
5,590,976 A 1/1997 Kilheffer et al.
5,655,361 A 8/1997 Kishi
5,736,838 A 4/1998 Dove et al.
5,755,096 A 5/1998 Holleyman
5,790,972 A 8/1998 Kohlenberger
5,865,247 A 2/1999 Paterson
5,879,137 A 3/1999 Yie
5,894,888 A 4/1999 Wiemers
5,907,970 A 6/1999 Havlovick et al.
6,138,764 A 10/2000 Scarsdale et al.
6,142,878 A 11/2000 Barin
6,164,910 A 12/2000 Mayleben
6,202,702 B1 3/2001 Ohira
6,208,098 B1 3/2001 Kume
6,254,462 B1 7/2001 Kelton
6,271,637 B1 8/2001 Kushion
6,273,193 B1 8/2001 Hermann
6,315,523 B1 11/2001 Mills
6,477,852 B2 11/2002 Dodo
6,484,490 B1 11/2002 Olsen
6,491,098 B1 12/2002 Dallas
6,529,135 B1 3/2003 Bowers et al.
6,626,646 B2 9/2003 Rajewski
6,719,900 B2 4/2004 Hawkins
6,765,304 B2 7/2004 Baten et al.
6,776,227 B2 8/2004 Beida
6,802,690 B2 10/2004 Han
6,808,303 B2 10/2004 Fisher
6,931,310 B2 8/2005 Shimizu et al.
6,936,947 B1 8/2005 Leijon
7,082,993 B2 8/2006 Ayoub
7,104,233 B2 9/2006 Ryczek et al.
7,170,262 B2 1/2007 Pettigrew
7,173,399 B2 2/2007 Sihler
7,308,933 B1 12/2007 Mayfield
7,312,593 B1 12/2007 Streicher et al.
7,336,514 B2 2/2008 Amarillas
7,445,041 B2 11/2008 O'Brien
7,494,263 B2 2/2009 Dykstra et al.
7,500,642 B2 3/2009 Cunningham
7,525,264 B2 4/2009 Dodge
7,563,076 B2 7/2009 Brunet
7,581,379 B2 9/2009 Yoshida
7,675,189 B2 3/2010 Grenier
7,683,499 B2 3/2010 Saucier
7,717,193 B2 5/2010 Egilsson et al.
7,755,310 B2 7/2010 West et al.
7,807,048 B2 10/2010 Collette
7,835,140 B2 11/2010 Mori
7,845,413 B2 12/2010 Shampine et al.
7,926,562 B2 4/2011 Poitzsch
7,894,757 B2 7/2011 Keast
7,977,824 B2 7/2011 Halen et al.
8,037,936 B2 10/2011 Neuroth
8,054,084 B2 11/2011 Schulz et al.
8,083,504 B2 12/2011 Williams
8,091,928 B2 1/2012 Carrier
8,096,354 B2 1/2012 Poitzsch
8,096,891 B2 1/2012 Lochtefeld
8,139,383 B2 3/2012 Efraimsson
8,146,665 B2 4/2012 Neal
8,154,419 B2 4/2012 Daussin et al.
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
8,506,267 B2 8/2013 Gambier et al.
8,534,235 B2 9/2013 Chandler
8,573,303 B2 11/2013 Kerfoot
8,596,056 B2 12/2013 Woodmansee
8,616,005 B1 12/2013 Cousino
8,616,274 B2 12/2013 Belcher et al.
8,646,521 B2 2/2014 Bowen
8,692,408 B2 4/2014 Zhang et al.
8,727,068 B2 5/2014 Bruin
8,760,657 B2 6/2014 Pope
8,763,387 B2 7/2014 Schmidt
8,774,972 B2 7/2014 Rusnak
8,789,601 B2 7/2014 Broussard
8,795,525 B2 8/2014 McGinnis et al.
8,800,652 B2 8/2014 Bartko
8,807,960 B2 8/2014 Stephenson
8,838,341 B2 9/2014 Kumano
8,851,860 B1 10/2014 Mail
8,857,506 B2 10/2014 Stone, Jr.
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,051,923 B2 6/2015 Kuo
9,061,223 B2 6/2015 Winborn
9,067,182 B2 6/2015 Nichols
9,103,193 B2 8/2015 Coli
9,119,326 B2 8/2015 McDonnell
9,121,257 B2 9/2015 Coli et al.
9,140,110 B2 9/2015 Coli et al.
9,160,168 B2 10/2015 Chapel
9,175,554 B1 11/2015 Watson
9,206,684 B2 12/2015 Parra
9,260,253 B2 2/2016 Naizer
9,322,239 B2 4/2016 Angeles Boza et al.
9,324,049 B2 4/2016 Thomeer
9,340,353 B2 5/2016 Oren

(56) References Cited

U.S. PATENT DOCUMENTS 9,366,114 B2 6/2016 Coli et al.
9,410,410 B2 8/2016 Broussard et al.
9,450,385 B2 9/2016 Kristensen
9,458,687 B2 10/2016 Hallundbaek
9,475,020 B2 10/2016 Coli et al.
9,475,021 B2 10/2016 Coli et al.
9,482,086 B2 11/2016 Richardson et al.
9,499,335 B2 11/2016 McIver
9,513,055 B1 12/2016 Seal
9,534,473 B2 1/2017 Morris et al.
9,562,420 B2 2/2017 Morris et al.
9,587,649 B2 3/2017 Oehring
9,611,728 B2 4/2017 Oehring
9,650,871 B2 5/2017 Oehring et al.
9,650,879 B2 5/2017 Broussard et al.
9,706,185 B2 7/2017 Ellis
9,728,354 B2 8/2017 Skolozdra
9,738,461 B2 8/2017 DeGaray
9,739,546 B2 8/2017 Bertilsson et al.
9,745,840 B2 8/2017 Oehring et al.
9,840,901 B2 12/2017 Oehring et al.
9,863,228 B2 1/2018 Shampine et al.
9,893,500 B2 2/2018 Oehring
9,909,398 B2 3/2018 Pham
9,915,128 B2 3/2018 Hunter
9,932,799 B2 4/2018 Symchuk
9,963,961 B2 5/2018 Hardin
9,970,278 B2 5/2018 Broussard
9,976,351 B2 5/2018 Randall
9,995,218 B2 6/2018 Oehring
10,008,880 B2 6/2018 Vicknair
10,020,711 B2 7/2018 Oehring
10,036,238 B2 7/2018 Oehring
10,107,086 B2 10/2018 Oehring
10,119,381 B2 11/2018 Oehring
10,184,465 B2 1/2019 Enis et al.
10,196,878 B2 2/2019 Hunter
10,227,854 B2 3/2019 Glass
10,232,332 B2 3/2019 Oehring
10,246,984 B2 4/2019 Payne
10,254,732 B2 4/2019 Oehring
10,260,327 B2 4/2019 Kajaria
10,280,724 B2 5/2019 Hinderliter
10,287,873 B2 5/2019 Filas
10,302,079 B2 5/2019 Kendrick
10,309,205 B2 6/2019 Randall
10,337,308 B2 7/2019 Broussard
10,371,012 B2 8/2019 Davis
10,378,326 B2 8/2019 Morris
10,393,108 B2 8/2019 Chong
10,407,990 B2 9/2019 Oehring
10,415,332 B2 9/2019 Morris
10,436,026 B2 10/2019 Ounadjela
10,627,003 B2 4/2020 Dale et al.
10,669,471 B2 6/2020 Schmidt et al.
10,669,804 B2 6/2020 Kotrla
10,695,950 B2 6/2020 Igo et al.
10,711,576 B2 7/2020 Bishop
2002/0169523 A1 11/2002 Ross et al.
2003/0056514 A1 3/2003 Lohn
2003/0079875 A1 5/2003 Weng
2003/0138327 A1 7/2003 Jones et al.
2004/0040746 A1 3/2004 Niedermayr
2004/0102109 A1 5/2004 Cratty et al.
2004/0167738 A1 8/2004 Miller
2005/0061548 A1 3/2005 Hooper
2005/0116541 A1 6/2005 Seiver
2005/0274508 A1 12/2005 Folk
2006/0052903 A1 3/2006 Bassett
2006/0065319 A1 3/2006 Csitari
2006/0260331 A1 11/2006 Andreychuk
2007/0131410 A1 6/2007 Hill
2007/0187163 A1 8/2007 Cone
2007/0201305 A1 8/2007 Heilman et al.
2007/0226089 A1 9/2007 DeGaray et al.
2007/0277982 A1 12/2007 Shampine
2007/0278140 A1 12/2007 Mallet et al.
2008/0017369 A1 1/2008 Sarada
2008/0041596 A1 2/2008 Blount
2008/0095644 A1 4/2008 Mantei et al.
2008/0112802 A1 5/2008 Orlando
2008/0137266 A1 6/2008 Jensen
2008/0208478 A1 8/2008 Ella et al.
2008/0217024 A1 9/2008 Moore
2008/0236818 A1 10/2008 Dykstra
2008/0264625 A1 10/2008 Ochoa
2008/0264640 A1 10/2008 Eslinger
2008/0264649 A1 10/2008 Crawford
2009/0045782 A1 2/2009 Datta
2009/0065299 A1 3/2009 Vito
2009/0078410 A1 3/2009 Krenek et al.
2009/0090504 A1 4/2009 Weightman
2009/0093317 A1 4/2009 Kajiwara et al.
2009/0095482 A1 4/2009 Surjaatmadja
2009/0145611 A1 6/2009 Pallini, Jr.
2009/0153354 A1 6/2009 Daussin et al.
2009/0188181 A1 7/2009 Forbis
2009/0200035 A1 8/2009 Bjerkreim et al.
2009/0260826 A1 10/2009 Sherwood
2009/0308602 A1 12/2009 Bruins et al.
2010/0000508 A1 1/2010 Chandler
2010/0019574 A1 1/2010 Baldassarre et al.
2010/0038907 A1 2/2010 Hunt
2010/0045109 A1 2/2010 Arnold
2010/0051272 A1 3/2010 Loree et al.
2010/0101785 A1 4/2010 Khvoshchev
2010/0132949 A1 6/2010 DeFosse et al.
2010/0146981 A1 6/2010 Motakef
2010/0172202 A1 7/2010 Borgstadt
2010/0200224 A1 8/2010 Nguete
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0052423 A1 3/2011 Gambier
2011/0061855 A1 3/2011 Case et al.
2011/0085924 A1 4/2011 Shampine
2011/0166046 A1 7/2011 Weaver
2011/0247878 A1 10/2011 Rasheed
2011/0272158 A1 11/2011 Neal
2012/0018016 A1 1/2012 Gibson
2012/0049625 A1 3/2012 Hopwood
2012/0085541 A1 4/2012 Love et al.
2012/0127635 A1 5/2012 Grindeland
2012/0152716 A1 6/2012 Kikukawa et al.
2012/0205301 A1 8/2012 McGuire et al.
2012/0205400 A1 8/2012 DeGaray et al.
2012/0222865 A1 9/2012 Larson
2012/0232728 A1 9/2012 Karimi et al.
2012/0247783 A1 10/2012 Berner, Jr.
2012/0255734 A1 10/2012 Coli et al.
2013/0009469 A1 1/2013 Gillett
2013/0025706 A1 1/2013 DeGaray et al.
2013/0175038 A1 7/2013 Conrad
2013/0175039 A1 7/2013 Guidry
2013/0180722 A1 7/2013 Olarte Caro
2013/0189629 A1 7/2013 Chandler
2013/0199617 A1 8/2013 DeGaray et al.
2013/0233542 A1 9/2013 Shampine
2013/0255271 A1 10/2013 Yu et al.
2013/0284278 A1 10/2013 Winborn
2013/0299167 A1 11/2013 Fordyce
2013/0306322 A1 11/2013 Sanborn
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0060658 A1 3/2014 Hains
2014/0095114 A1 4/2014 Thomeer
2014/0096974 A1 4/2014 Coli

(56) References Cited

U.S. PATENT DOCUMENTS

2014/0124162 A1 5/2014 Leavitt
2014/0138079 A1 5/2014 Broussard
2014/0174717 A1 6/2014 Broussard et al.
2014/0219824 A1 8/2014 Burnette
2014/0238683 A1 8/2014 Korach
2014/0246211 A1 9/2014 Guidry et al.
2014/0251623 A1 9/2014 Lestz et al.
2014/0255214 A1 9/2014 Burnette
2014/0277772 A1 9/2014 Lopez
2014/0290768 A1 10/2014 Randle
2014/0379300 A1 12/2014 Devine et al.
2015/0027712 A1 1/2015 Vicknair
2015/0053426 A1 2/2015 Smith
2015/0068724 A1 3/2015 Coli et al.
2015/0068754 A1 3/2015 Coli et al.
2015/0075778 A1 3/2015 Walters
2015/0083426 A1 3/2015 Lesko
2015/0097504 A1 4/2015 Lamascus
2015/0114652 A1 4/2015 Lestz
2015/0136043 A1 5/2015 Shaaban
2015/0144336 A1 5/2015 Hardin et al.
2015/0159911 A1 6/2015 Holt
2015/0175013 A1 6/2015 Cryer et al.
2015/0176386 A1 6/2015 Castillo et al.
2015/0211512 A1 7/2015 Wiegman
2015/0211524 A1 7/2015 Broussard
2015/0217672 A1 8/2015 Shampine
2015/0225113 A1 8/2015 Lungu
2015/0252661 A1 9/2015 Glass
2015/0300145 A1 10/2015 Coli et al.
2015/0300336 A1 10/2015 Hernandez et al.
2015/0314225 A1 11/2015 Coli et al.
2015/0330172 A1 11/2015 Allmaras
2015/0354322 A1 12/2015 Vicknair
2016/0032703 A1 2/2016 Broussard et al.
2016/0102537 A1 4/2016 Lopez
2016/0105022 A1 4/2016 Oehring
2016/0208592 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208593 A1 7/2016 Coli et al.
2016/0208594 A1 7/2016 Coli et al.
2016/0208595 A1 7/2016 Tang
2016/0221220 A1 8/2016 Paige
2016/0230524 A1 8/2016 Dumoit
2016/0230525 A1 8/2016 Lestz et al.
2016/0258267 A1 9/2016 Payne
2016/0265457 A1 9/2016 Stephenson
2016/0273328 A1 9/2016 Oehring
2016/0273456 A1 9/2016 Zhang et al.
2016/0281484 A1 9/2016 Lestz
2016/0290114 A1 10/2016 Oehring
2016/0290563 A1 10/2016 Diggins
2016/0312108 A1 10/2016 Lestz et al.
2016/0319650 A1 11/2016 Oehring
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0016433 A1 1/2017 Chong
2017/0021318 A1 1/2017 McIver et al.
2017/0022788 A1 1/2017 Oehring et al.
2017/0022807 A1 1/2017 Dursun
2017/0028368 A1 2/2017 Oehring et al.
2017/0030177 A1 2/2017 Oehring
2017/0030178 A1 2/2017 Oehring et al.
2017/0036178 A1 2/2017 Coli et al.
2017/0036872 A1 2/2017 Wallace
2017/0037717 A1 2/2017 Oehring
2017/0037718 A1 2/2017 Coli et al.
2017/0043280 A1 2/2017 Vankouwenberg
2017/0051732 A1 2/2017 Hemandez et al.
2017/0074076 A1 3/2017 Joseph et al.
2017/0096885 A1 4/2017 Oehring
2017/0104389 A1 4/2017 Morris et al.
2017/0114625 A1 4/2017 Norris
2017/0130743 A1 5/2017 Anderson
2017/0138171 A1 5/2017 Richards et al.
2017/0145918 A1 5/2017 Oehring
2017/0146189 A1 5/2017 Herman
2017/0159570 A1 6/2017 Bickert
2017/0159654 A1 6/2017 Kendrick
2017/0175516 A1 6/2017 Eslinger
2017/0218727 A1 8/2017 Oehring
2017/0218843 A1 8/2017 Oehring
2017/0222409 A1 8/2017 Oehring
2017/0226838 A1 8/2017 Ciezobka
2017/0226839 A1 8/2017 Broussard
2017/0226842 A1 8/2017 Omont et al.
2017/0234250 A1 8/2017 Janik
2017/0241221 A1 8/2017 Seshadri
2017/0259227 A1 9/2017 Morris et al.
2017/0292513 A1 10/2017 Haddad
2017/0313499 A1 11/2017 Hughes et al.
2017/0314380 A1 11/2017 Oehring
2017/0314979 A1 11/2017 Ye et al.
2017/0328179 A1 11/2017 Dykstra
2017/0369258 A1 12/2017 DeGaray
2018/0028992 A1 2/2018 Stegemoeller
2018/0038216 A1 2/2018 Zhang
2018/0045331 A1 2/2018 Lopez
2018/0156210 A1 6/2018 Oehring
2018/0183219 A1 6/2018 Oehring
2018/0216455 A1 8/2018 Andreychuk
2018/0238147 A1 8/2018 Shahri
2018/0245428 A1 8/2018 Richards
2018/0258746 A1 9/2018 Broussard
2018/0266412 A1 9/2018 Stokkevag
2018/0274446 A1 9/2018 Oehring
2018/0291713 A1 10/2018 Jeanson
2018/0320483 A1 11/2018 Zhang
2018/0343125 A1 11/2018 Clish
2018/0363437 A1 12/2018 Coli
2019/0003329 A1 1/2019 Morris
2019/0010793 A1 1/2019 Hinderliter
2019/0063309 A1 2/2019 Davis
2019/0100989 A1 4/2019 Stewart
2019/0112910 A1 4/2019 Oehring
2019/0119096 A1 4/2019 Haile
2019/0120024 A1 4/2019 Oehring
2019/0128080 A1 5/2019 Ross
2019/0162061 A1 5/2019 Stephenson
2019/0169971 A1 6/2019 Oehring
2019/0178057 A1 6/2019 Hunter
2019/0178235 A1 6/2019 Coskrey
2019/0203567 A1 7/2019 Ross
2019/0203572 A1 7/2019 Morris
2019/0211661 A1 7/2019 Reckels
2019/0226317 A1 7/2019 Payne
2019/0245348 A1 8/2019 Hinderliter
2019/0292866 A1 9/2019 Ross
2019/0292891 A1 9/2019 Kajaria
2019/0316447 A1 10/2019 Oehring
2020/0047141 A1 2/2020 Oehring et al.
2020/0088152 A1 3/2020 Allion et al.
2020/0232454 A1 7/2020 Chretien

FOREIGN PATENT DOCUMENTS

CA 2707269 12/2010
CA 2482943 5/2011
CA 3050131 11/2011
CA 2955706 10/2012
CA 2966672 10/2012
CA 3000322 4/2013
CA 2787814 2/2014
CA 2833711 5/2014
CA 2978706 9/2016
CA 2944980 2/2017
CA 3006422 6/2017

(56) References Cited

FOREIGN PATENT DOCUMENTS

| | | | |
|---|---|---|---|
| CA | 3018485 | | 8/2017 |
| CA | 2964593 | | 10/2017 |
| CA | 2849825 | | 7/2018 |
| CA | 3067854 | A1 | 1/2019 |
| CA | 2919649 | | 2/2019 |
| CA | 2919666 | | 7/2019 |
| CA | 2797081 | | 9/2019 |
| CA | 2945579 | | 10/2019 |
| CN | 201687513 | | 12/2010 |
| CN | 101977016 | | 2/2011 |
| CN | 202023547 | | 11/2011 |
| CN | 102602322 | | 7/2012 |
| CN | 205986303 | U | 2/2017 |
| CN | 108049999 | A | 5/2018 |
| JP | 2004264589 | | 9/2004 |
| WO | 2016/144939 | | 9/2016 |
| WO | 2016/160458 | | 10/2016 |

OTHER PUBLICATIONS

International Search Report and Written Opinion dated Jan. 2, 2019 in related PCT Patent Application No. PCT/US18/54542.
International Search Report and Written Opinion dated Jan. 2, 2019 in related PCT Patent Application No. PCT/US18/54548.
International Search Report and Written Opinion dated Dec. 31, 2018 in related PCT Patent Application No.PCT/US18/55913.
International Search Report and Written Opinion dated Jan. 4, 2019 in related PCT Patent Application No. PCT/US18/57539.
International Search Report and Written Opinion dated Jan. 2, 2020 in related PCT Application No. PCT/US19/55325.
Notice of Allowance dated Jan. 9, 2020 in related U.S. Appl. No. 16/570,331.
Non-Final Office Action dated Dec. 23, 2019 in related U.S. Appl. No. 16/597,008.
Non-Final Office Action dated Jan. 10, 2020 in related U.S. Appl. No. 16/597,014.
Non-Final Office Action dated Dec. 6, 2019 in related U.S. Appl. No. 16/564,186.
International Search Report and Written Opinion dated Nov. 26, 2019 in related PCT Application No. PCT/US19/51018.
International Search Report and Written Opinion dated Feb. 11, 2020 in related PCT Application No. PCT/US2019/055323.
Non-Final Office Action dated Feb. 12, 2019 in related U.S. Appl. No. 16/170,695.
International Search Report and Written Opinion dated Feb. 15, 2019 in related PCT Application No. PCT/US18/63977.
Non-Final Office Action dated Feb. 25, 2019 in related U.S. Appl. No. 16/210,749.
International Search Report and Written Opinion dated Mar. 5, 2019 in related PCT Application No. PCT/US18/63970.
Non-Final Office Action dated Mar. 6, 2019 in related U.S. Appl. No. 15/183,387.
Office Action dated Mar. 1, 2019 in related Canadian Patent Application No. 2,943,275.
Office Action dated Jan. 30, 2019 in related Canadian Patent Application No. 2,936,997.
International Search Report and Written Opinion dated Jul. 9, 2019 in corresponding PCT Application No. PCT/US2019/027584.
Office Action dated Jun. 11, 2019 in corresponding U.S. Appl. No. 16/210,749.
Office Action dated May 10, 2019 in corresponding U.S. Appl. No. 16/268,030.
Canadian Office Action dated May 30, 2019 in corresponding CA Application No. 2,833,711.
Canadian Office Action dated Jun. 20, 2019 in corresponding CA Application No. 2,964,597.
Office Action dated Jun. 7, 2019 in corresponding U.S. Appl. No. 16/268,030.
International Search Report and Written Opinion dated Sep. 11, 2019 in related PCT Application No. PCT/US2019/037493.
Office Action dated Aug. 19, 2019 in related U.S. Appl. No. 15/356,436.
Office Action dated Oct. 2, 2019 in related U.S. Appl. No. 16/152,732.
Office Action dated Sep. 11, 2019 in related U.S. Appl. No. 16/268,030.
Office Action dated Oct. 11, 2019 in related U.S. Appl. No. 16/385,070.
Office Action dated Sep. 3, 2019 in related U.S. Appl. No. 15/994,772.
Office Action dated Sep. 20, 2019 in related U.S. Appl. No. 16/443,273.
Canadian Office Action dated Oct. 1, 2019 in related Canadian Patent Application No. 2,936,997.
UK Power Networks—Transformers to Supply Heat to Tate Modern—from Press Releases May 16, 2013.
Non-Final Office Action issued in corresponding U.S. Appl. No. 15/293,681 dated Feb. 16, 2017.
Non-Final Office Action issued in corresponding U.S. Appl. No. 15/294,349 dated Mar. 14, 2017.
Final Office Action issued in corresponding U.S. Appl. No. 15/145,491 dated Jan. 20, 2017.
Non-Final Office Action issued in corresponding U.S. Appl. No. 15/145,443 dated Feb. 7, 2017.
Notice of Allowance issued in corresponding U.S. Appl. No. 15/217,040 dated Mar. 28, 2017.
Notice of Allowance issued in corresponding U.S. Appl. No. 14/622,532 dated Mar. 27, 2017.
Non-Final Office Action issued in corresponding U.S. Appl. No. 15/291,842 dated Jan. 6, 2017.
Final Office Action issued in corresponding U.S. Appl. No. 14/622,532 dated Dec. 7, 2016.
Non-Final Office Action issued in corresponding U.S. Appl. No. 14/622,532 dated May 17, 2016.
Final Office Action issued in corresponding U.S. Appl. No. 14/622,532 dated Dec. 21, 2015.
Non-Final Office Action issued in corresponding U.S. Appl. No. 14/622,532 dated Aug. 5, 2015.
Non-Final Office Action issued in corresponding U.S. Appl. No. 15/145,491 dated Sep. 12, 2016.
Non-Final Office Action issued in corresponding Application No. 15/217,040 dated Nov. 29, 2016.
Non-Final Office Action issued in corresponding U.S. Appl. No. 15/235,788 dated Dec. 14, 2016.
Non-Final Office Action issued in corresponding U.S. Appl. No. 15/145,491 dated May 15, 2017.
Non-Final Office Action issued in corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.
Final Office Action issued in corresponding U.S. Appl. No. 15/294,349 dated Jul. 6, 2017.
Non-Final Office Action issued in corresponding U.S. Appl. No. 14/884,363 dated Sep. 5, 2017.
Final Office Action issued in corresponding U.S. Appl. No. 15/145,491 dated Sep. 6, 2017.
Non-Final Office Action issued in corresponding U.S. Appl. No. 14/881,535 dated Oct. 6, 2017.
Non-Final Office Action issued in corresponding U.S. Appl. No. 15/145,414 dated Nov. 29, 2017.
Non-Final Office Action issued in corresponding U.S. Appl. No. 15/644,487 dated Nov. 13, 2017.
Canadian Office Action dated Mar. 2, 2018 in related Canadian Patent Application No. 2,833,711.
Office Action dated Apr. 10, 2018 in related U.S. Appl. No. 15/294,349.
Office Action dated Apr. 2, 2018 in related U.S. Appl. No. 15/183,387.
Office Action dated May 29, 2018 in related U.S. Appl. No. 15/235,716.
Candian Office Action dated Apr. 18, 2018 in related Canadian Patent Application No. 2,928,711.
Canadian Office Action dated Jun. 22, 2018 in related Canadian Patent Application No. 2,886,697.

(56) References Cited

OTHER PUBLICATIONS

Office Action dated Jul. 25, 2018 in related U.S. Appl. No. 15/644,487.
Office Action dated Oct. 4, 2018 in related U.S. Appl. No. 15/217,081.
International Search Report and Written Opinion dated Sep. 19, 2018 in related PCT Patent Application No. PCT/US2018/040683.
Canadian Office Action dated Sep. 28, 2018 in related Canadian Patent Application No. 2,945,281.
International Search Report and Written Opinion dated Apr. 10, 2019 in corresponding PCT Application No. PCT/US2019/016635.
Notice of Allowance dated Apr. 23, 2019 in corresponding U.S. Appl. No. 15/635,028.
Schlumberger, "Jet Manual 23, Fracturing Pump Units, SPF/SPS-343, Version 1.0," Jan. 31, 2007, 68 pages.
Stewart & Stevenson, "Stimulation Systems," 2007, 20 pages.
Luis Gamboa, "Variable Frequency Drives in Oil and Gas Pumping Systems," Dec. 17, 2011, 5 pages.
"Griswold Model 811 Pumps: Installation, Operation and Maintenance Manual, ANSI Process Pump," 2010, 60 pages.
International Search Report and Written Opinion dated Jun. 2, 2020 in corresponding PCT Application No. PCT/US20/23809.
International Search Report and Written Opinion dated Jun. 23, 2020 in corresponding PCT Application No. PCT/US20/23912.
International Search Report and Written Opinion dated Jul. 22, 2020 in corresponding PCT Application No. PCT/US20/00017.
Office Action dated Aug. 4, 2020 in related U.S. Appl. No. 16/385,070.
Office Action dated Jun. 29, 2020 in related U.S. Appl. No. 16/404,283.
Office Action dated Jun. 29, 2020 in related U.S. Appl. No. 16/728,359.
Office Action dated Jun. 22, 2020 in related U.S. Appl. No. 16/377,861.
Canadian Office Action dated Aug. 18, 2020 in related CA Patent Application No. 2,933,444.
Canadian Office Action dated Aug. 17, 2020 in related CA Patent Application No. 2,944,968.
Non-Final Office Action dated Mar. 31, 2020 issued in U.S. Appl. No. 15/356,436.
Final Office Action dated Mar. 3, 2020 issued in U.S. Appl. No. 16/152,695.
Non-Final Office Action issued in U.S. Appl. No. 14/881,535 dated May 20, 2020.
Non-Final Office Action issued in U.S. Appl. No. 15/145,443 dated May 8, 2020.
Non-Final Office Action issued in U.S. Appl. No. 16/458,696 dated May 22, 2020.
International Search Report and Written Opinion issued in PCT/US2020/023809 dated Jun. 2, 2020.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines (Year 2015).
Goodwin, "High-voltage auxilliary switchgear for power stations," Power Engineering Journal, 1989, 10 pg. (Year 1989).
Non-Final Office dated Oct. 26, 2020 in U.S. Appl. No. 15/356,436.
Non-Final Office dated Oct. 5, 2020 in U.S. Appl. No. 16/443,273.
Non-Final Office Action dated Sep. 29, 2020 in U.S. Appl. No. 16/943,727.
Non-Final Office Action dated Sep. 2, 2020 in U.S. Appl. No. 16/356,263.
Non-Final Office Action dated Aug. 31, 2020 in U.S. Appl. No. 16/167,083.
Albone, "Mobile Compressor Stations for Natural Gas Transmission Service," ASME 67-GT-33, Turbo Expo, Power for Land, Sea and Air, vol. 79887, p. 1-10, 1967.
Canadian Office Action dated Sep. 22, 2020 in Canadian Application No. 2,982,974.
International Search Report and Written Opinion dated Sep. 3, 2020 in PCT/US2020/36932.
"Process Burner" (https://www.cebasrt.com/productsloii-gaslprocess-burner) Sep. 6, 2018 (Sep. 6, 2018), entire document, especially para (Burners for refinery Heaters) .
Water and Glycol Heating Systems• (https://www.heat-inc.com/wg-series-water-glycol-systems/) Jun. 18, 2018 (Jun. 18, 2018), entire document, especially WG Series Water Glycol Systems.
"Heat Exchanger" (https://en.wikipedia.org/w/index.php?title=Heat_exchanger&oldid=89300146) Dec. 18, 2019 Apr. 2019 (Apr. 18, 2019), entire document, especially para (0001).
Canadian Office Action dated Sep. 8, 2020 in Canadian Patent Application No. 2,928,707.
Canadian Office Action dated Aug. 31, 2020 in Canadian Patent Application No. 2,944,980.
International Search Report and Written Opinion dated Aug. 28, 2020 in PCT/US20/23821.

CABLE MANAGEMENT OF ELECTRIC POWERED HYDRAULIC FRACTURING PUMP UNIT

CROSS REFERENCE TO RELATED APPLICATIONS

This application is a continuation of U.S. patent application Ser. No. 15/145,491, filed May 3, 2016, which is now U.S. Pat. No. 10,036,238, issued Jul. 31, 2018, which claims priority to and the benefit of, U.S. Provisional Application Ser. No. 62/156,303, filed May 3, 2015 and is a continuation-in-part of, and claims priority to and the benefit of U.S. patent application Ser. No. 13/679,689, filed Nov. 16, 2012, which is now U.S. Pat. No. 9,410,410, issued Aug. 9, 2016, the full disclosures of which are hereby incorporated by reference herein for all purposes.

BACKGROUND OF THE INVENTION

1. Field of Invention

The present disclosure relates to hydraulic fracturing of subterranean formations. In particular, the present disclosure relates to electrical components and connections connected to an electric hydraulic fracturing pump to minimize space and time requirements for rig up and rig down.

2. Description of Prior Art

Hydraulic fracturing is a technique used to stimulate production from some hydrocarbon producing wells. The technique usually involves injecting fluid into a wellbore at a pressure sufficient to generate fissures in the formation surrounding the wellbore. Typically the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. Other primary fluids sometimes used for the slurry include nitrogen, carbon dioxide, foam, diesel, or other fluids. A typical hydraulic fracturing fleet may include a data van unit, blender unit, hydration unit, chemical additive unit, hydraulic fracturing pump unit, sand equipment, electric wireline, and other equipment.

Traditionally, the fracturing fluid slurry has been pressurized on surface by high pressure pumps powered by diesel engines. To produce the pressures required for hydraulic fracturing, the pumps and associated engines have substantial volume and mass. Heavy duty trailers, skids, or trucks are required for transporting the large and heavy pumps and motors to sites where wellbores are being fractured. Each hydraulic fracturing pump usually includes power and fluid ends, as well as seats, valves, springs, and keepers internally. These parts allow the hydraulic fracturing pump to draw in low pressure fluid slurry (at approximately 100 psi) and discharge the same fluid slurry at high pressures (up to 15,000 psi or more). Recently electrical motors have been introduced to replace the diesel motors, which greatly reduces the noise generated by the equipment during operation. After being transported to a wellsite electrically powered fracturing equipment, i.e. motors for pressurizing fracturing and hydraulic fluids, are connected to electrical power sources. Electrical connection for this equipment is time consuming, and the current electrical distribution configurations require numerous cables that occupy valuable space.

SUMMARY OF THE INVENTION

Disclosed herein is an example of a hydraulic fracturing system for fracturing a subterranean formation, and which includes first and second pumps, first and second motors for driving the first and second pumps, a transformer, a first electrical circuit between the first motor and the transformer, and through which the first motor and transformer are in electrical communication, and a second electrical circuit that is separate and isolated from the first electrical circuit, and that is between the second motor and the transformer, and through which the second motor and transformer are in electrical communication. A cable assembly can be included which has an electrically conducting cable, a transformer end plug on one end of the cable and in electrical communication with the cable, and a motor end plug on an end of the cable distal from the transformer end plug and that is in electrical communication with the cable. A transformer receptacle can further be included that is in electrical communication with the transformer, and a motor receptacle in electrical communication with a one of the first or second motors, so that when the transformer end plug is inserted into the transformer receptacle, and the motor end plug is inserted into the motor receptacle, the transformer and a one of the first or second motors are in electrical communication, and wherein the plugs are selectively withdrawn from the receptacles. The hydraulic fracturing system can further include a multiplicity of cable assemblies, transformer receptacles, and motor receptacles, wherein three phase electricity is transferred between the transformer and the first or second motors in different cables. The receptacles can be strategically arranged so that cable assemblies that conduct electricity at the same phase are adjacent one another. A transformer ground receptacle can further be included that is in electrical communication with a ground leg of the transformer, and a pump ground receptacle in electrical communication with a ground leg of one of the first or second pumps, so that when the transformer ground plug is inserted into the transformer ground receptacle, and the pump ground plug is inserted into the pump receptacle, the transformer ground leg and the ground leg of one of the first or second pumps are in electrical communication, and wherein the plugs are selectively withdrawn from the receptacles. The hydraulic fracturing system can also include a platform on which the first and second pumps and motors are mounted, an enclosure on the platform, one or more variable frequency drives coupled with one or more of the motors and within the enclosure, and a removable panel on the enclosure adjacent the variable frequency drive, so that by removing the panel the variable frequency drive is easily accessible.

Another example of a hydraulic fracturing system for fracturing a subterranean formation includes a source of electricity, a row of source receptacles that are in electrical communication with the source of electricity and configured so that some of the source receptacles receive electricity from the source of electricity at a phase that is different from a phase of electricity received by other source receptacles from the source of electricity, an electrically powered motor that is spaced apart from the source of electricity, a row of motor receptacles that are in electrical communication with the motor, and cable assemblies. The cable assemblies include a source plug that is selectively insertable into a one of the source receptacles, a motor plug that is selectively insertable into a one of the motor receptacles, and a cable in electrical communication with both the source plug and motor plug, so that when the source plug inserts into a one of the source receptacles, and the motor plug inserts into the a one of the motor receptacles, electricity at a designated phase is transmitted from the source of electricity to the variable frequency drive to operate and control a motor. The source of electricity can be a transformer having alternating current electricity at three different phases. In an example, the motor is a first motor, the system further having a second motor, and wherein the first and second motors each drive fracturing pumps. In an embodiment, electricity conducts from the source of electricity to the first motor along a first path, wherein electricity conducts from the source of electricity to the second motor along a second path, and wherein the first and second paths are separate and distinct from one another. In another embodiment, electricity conducts from the source of electricity to a single variable frequency drive which supplies power to a single motor which turns more than one hydraulic fracturing pump. A first pair of the source receptacles can receive electricity at a first phase, so that a corresponding first pair of cable assemblies that have source plugs inserted into the source receptacles conduct electricity at the first phase, wherein a second pair of the source receptacles receive electricity at a second phase, so that a corresponding second pair of cable assemblies that have source plugs inserted into the source receptacles conduct electricity at the second phase, and wherein a third pair of the source receptacles receive electricity at a third phase, so that a corresponding third pair of cable assemblies that have source plugs inserted into the source receptacles conduct electricity at the third phase.

A method of hydraulic fracturing is described herein and that includes electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with variable frequency drive, which is in electrical communication with the motor, which is in mechanical communication with the hydraulic fracturing pump that discharges high pressure hydraulic fracturing fluid slurry to the wellbore. The source of electricity transmits electricity to the source receptacle, so that electricity conducts from the source receptacle, to the motor receptacle, to the variable frequency drive, and to the motor. The source of electricity can be a transformer that transmits 3-phase electricity. In an embodiment, the fracturing pump motor includes a first fracturing pump motor, and wherein the cable assembly comprises a first cable assembly, the method further comprising repeating the steps of electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, directing fracturing fluid to a suction end of a fracturing pump that is coupled with the fracturing pump motor, and causing the source of electricity to transmit electricity to the source receptacle, so that electricity conducts from the source receptacle, to the source and motor ends, to the motor receptacle, and to the motor using a second fracturing pump motor and a second cable assembly. The method can also include removing the ends of the cable assembly from the receptacles, moving the source of electricity and fracturing pump motor to a different location, and repeating the steps of electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, directing fracturing fluid to a suction end of a fracturing pump that is coupled with the fracturing pump motor, and causing the source of electricity to transmit electricity to the source receptacle, so that electricity conducts from the source receptacle, to the source and motor ends, to the motor receptacle, and to the motor. The method can optionally further include repeating the step of electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, so that multiple cable assemblies are connected between multiple source receptacles and multiple motor receptacles, so that electricity at different phases is conducted through the different cable assemblies to the fracturing pump motor. Optionally, a path of electricity between the source of electricity and the first fracturing pump motor is separate and distinct from a path of electricity between the source of electricity and the second fracturing pump motor.

BRIEF DESCRIPTION OF DRAWINGS

Some of the features and benefits of the present invention having been stated, others will become apparent as the description proceeds when taken in conjunction with the accompanying drawings, in which.

Figure 1:
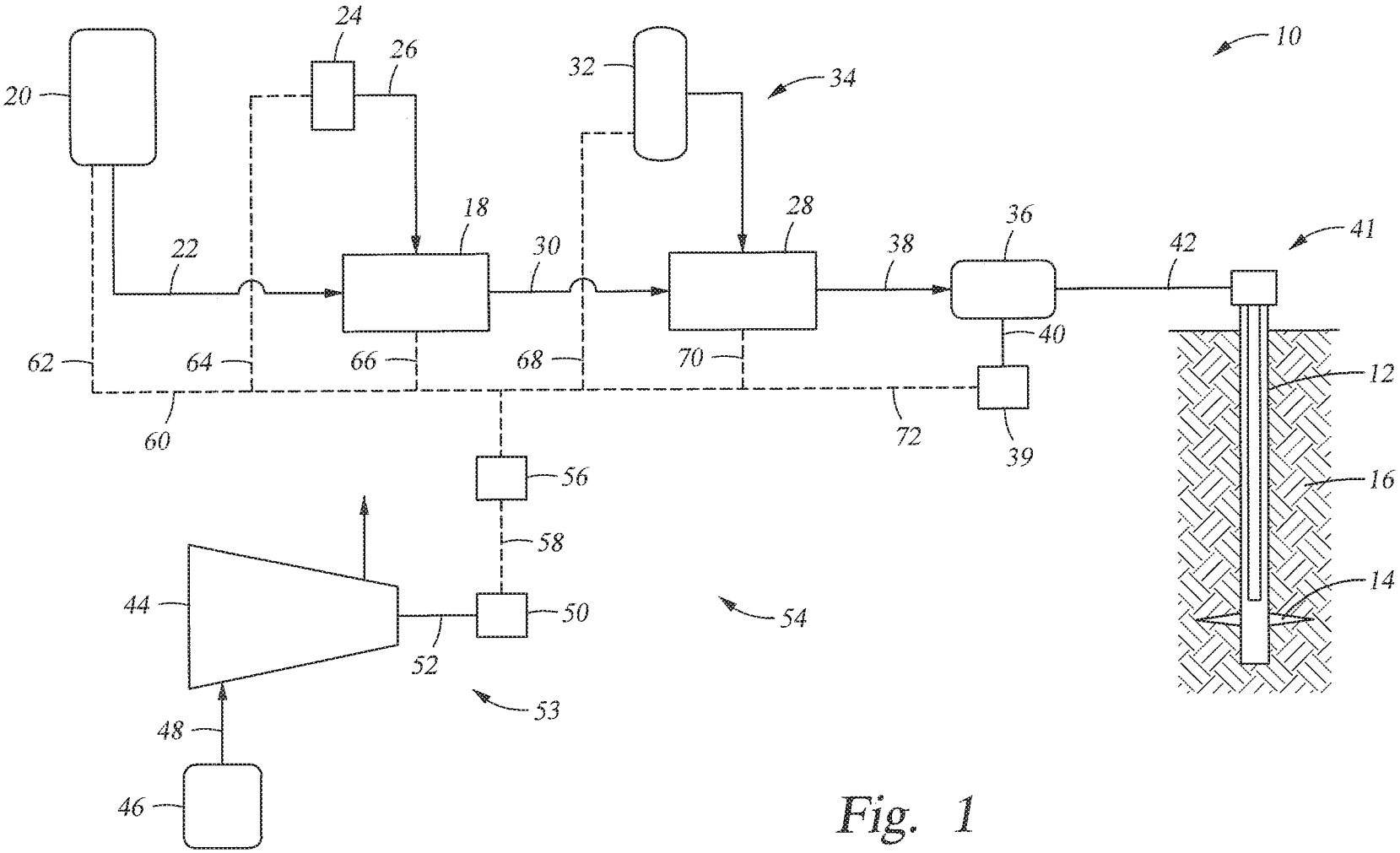
FIG. 1 is a schematic of an example of a hydraulic fracturing system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid. In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28 which is the suction (or boost) for the fracturing pump system 36. Blender unit 28 can have an onboard chemical additive system, such as with chemical pumps and augers (not shown). Optionally, additive source 24 can provide chemicals to blender unit 28; or a separate and standalone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36. A motor 39, which connects to pump system 36 via connection 40, drives pump system 36 so that it can pressurize the slurry. In one example, the motor 39 is controlled by a variable frequency drive ("VFD"). After being discharged from pump system 36, slurry is injected into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form a fracturing fluid that is then pumped into the wellbore 12 for fracturing the formation 14, and is not limited to fluids having chemicals or proppant. Examples exist wherein the system 10 includes multiple pumps 36, and multiple motors 39 for driving the multiple pumps 36. Examples also exist wherein the system 10 includes the ability to pump down equipment, instrumentation, or other retrievable items through the slurry into the wellbore.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50. An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other example step down voltages include 4,160 V, 480 V, or other voltages. The output or low voltage side of the transformer 56 connects to a power bus 60, lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60, and line 72 connects motor 39 to bus 60. In an example, additive source 24 contains ten or more chemical pumps for supplementing the existing chemical pumps on the hydration unit 18 and blender unit 28. Chemicals from the additive source 24 can be delivered via lines 26 to either the hydration unit 18 and/or the blender unit 28. In one embodiment, the elements of the system 10 are mobile and can be readily transported to a wellsite adjacent the wellbore 12, such as on trailers or other platforms equipped with wheels or tracks.

Figure 2:
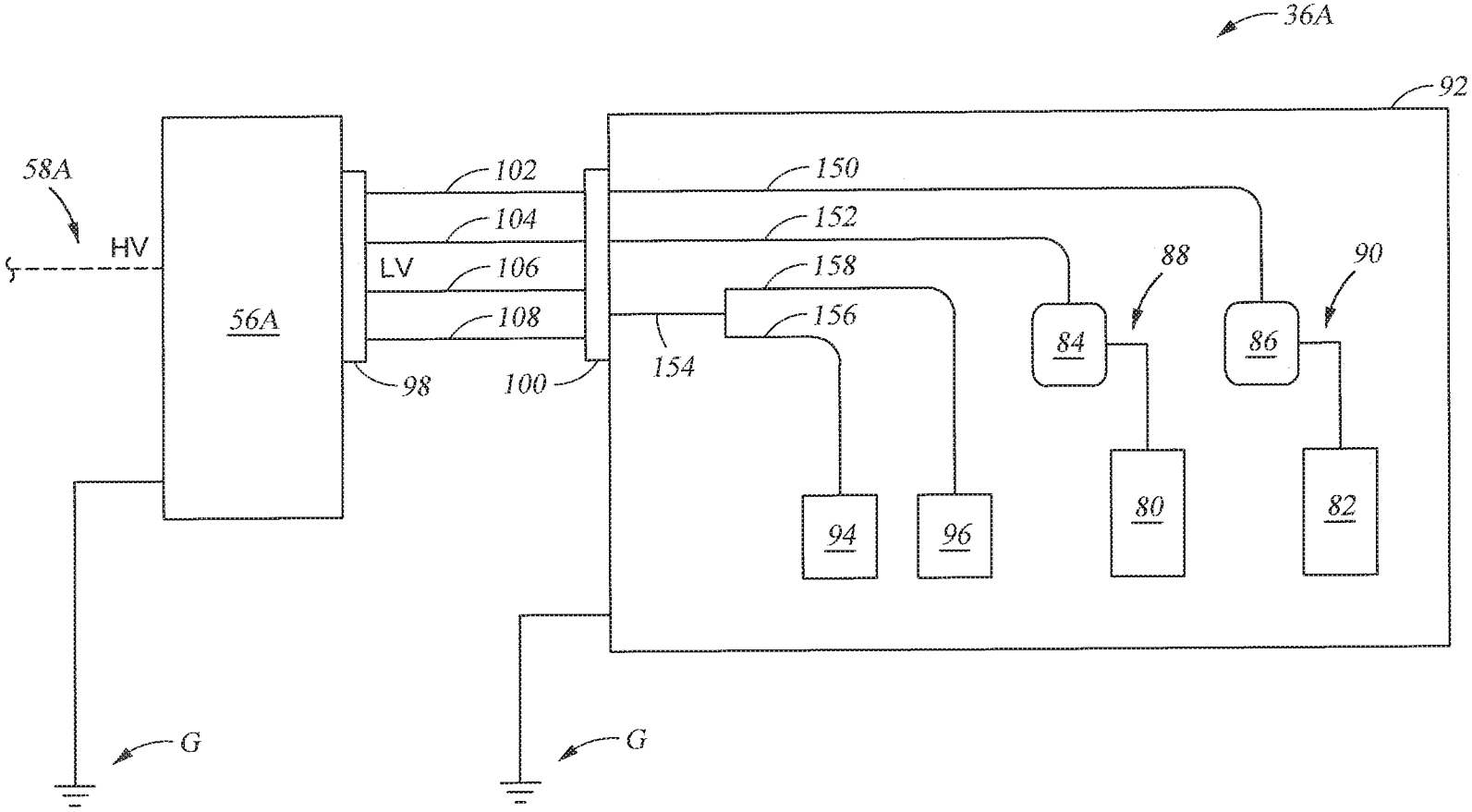
FIG. 2 is schematic of an example of electrical communication between a transformer and fracturing pump system of the hydraulic fracturing system of FIG. 1.

Schematically illustrated in FIG. 2 is one example of a fracturing pump system 36A having pumps 80, 82 that are respectively powered by motors 84, 86. Couplings 88, 90 mechanically affix the pumps 80, 82 with motors 84, 86 so that when motors 84, 86 are energized, the motors 84, 86 will drive pumps 80, 82 for pressurizing fracturing fluid that is then delivered to the wellbore 12 (FIG. 1). In this example, the fracturing pump system 36A is mounted on a trailer 92 which provides a mobile surface for transporting components of the fracturing pump system 36A to and from designated locations. Thus when operations at a wellsite are deemed complete, the fracturing pump system 36A can be transported to another wellsite for subsequent operations, or to a facility for repair or maintenance. Also schematically represented on trailer 92 and as part of the fracturing pump system 36A, are a motor control center 94 and auxiliary components 96. Examples of auxiliaries include heaters for the motors 84, 86, lights on the fracturing pump system 36A, control power for a variable frequency drive (not shown), heater for lube oil for pumps 80, 82, air blowers (not shown) for motors 84, 86, a hydraulic pump motor, and a hydraulic cooler motor (not shown). Not shown are variable frequency drives to control and operate motors 84, 86. In another embodiment, a single variable frequency drive controls and operates a single motor 84 which turns one or more hydraulic fracturing pumps (80 and 82).

Also shown in FIG. 2 is an example of transformer 56A having a high voltage side HV connected to line 58A; junction boxes 98, 100 respectively mounted on transformer 56A and fracturing pump system 36A provide means for electrical communication between transformer 56A and fracturing pump system 36A. Junction box 98 is mounted on a low voltage side LV of the transformer 56 A As will be described in more detail below, junction boxes 98, 100 are equipped with quick disconnect receptacles so that lines having conductive wires and that conduct electricity between transformer 56A and fracturing pump system 36A, can be easily inserted and removed by operations personnel to significantly reduce the time required for assembly and disassembly of the hydraulic fracturing system 10. The electrically conducting lines between junction boxes 98, 100 include wire bundles 102, 104, which as will be described below each include a number of wires within and that are separable and distinct from one another. Wire bundles 102, 104 conduct electrical power from transformer 56 A and to junction box 100 and which is used for energizing motors 84, 86. Also extending between junction boxes 98, 100 is line 106 and which conducts electricity that is used for powering the motor control center 94 and auxiliary components 96. Also extending between junction boxes 98, 100 is line 108 which is used as a ground between the transformer 56A and the hydraulic fracturing pump unit 36A. In one embodiment, the power generated is of the same voltage as the power supplied to the hydraulic fracturing pump unit 36. In this case, power for the hydraulic fracturing pump unit 36 is supplied directly without needing a transformer 56.

Figure 3:
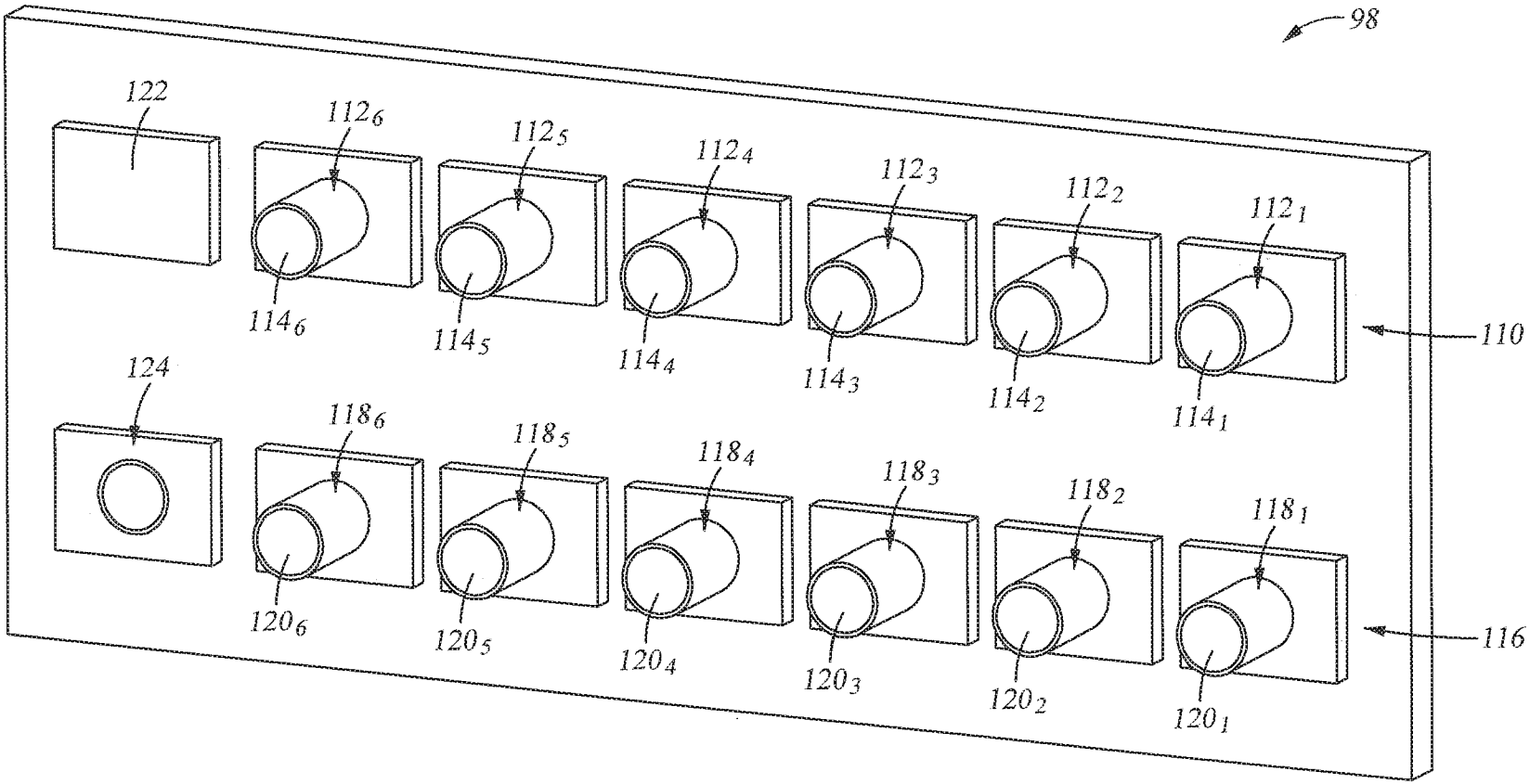
FIG. 3 is an end perspective views of an example of a junction box on the transformer of FIG. 2.

FIG. 3 shows an end perspective view of an example of junction box 98 and having a row 110 of receptacles $\mathbf{112}_1$-$\mathbf{112}_6$. The receptacles $\mathbf{112}_1$-$\mathbf{112}_6$ are each equipped with an opening $\mathbf{114}_1$-$\mathbf{114}_6$ in which an electrical conducting plug can be readily inserted and removed thereby providing electrical communication between the plug and attached conducting lead (such as a cable). Set below and extending generally parallel with row 110 is row 116 which also includes receptacles $\mathbf{118}_1$-$\mathbf{118}_6$, wherein the receptacles $\mathbf{118}_1$-$\mathbf{118}_6$ are each equipped with openings $\mathbf{120}_1$-$\mathbf{120}_6$ for receiving an electrically conducting plug. Set adjacent receptacle $\mathbf{112}_6$ is a ground connection 122 which connects to ground leads within transformer 36A (FIG. 2). Below ground connection 122 is an auxiliary/MCC connection 124, which provides a source of electrical power for the auxiliary components 96 and motor control center 94 (FIG. 2). In another embodiment, the receptacles can be arranged in different patterns and configurations.

Figure 4:
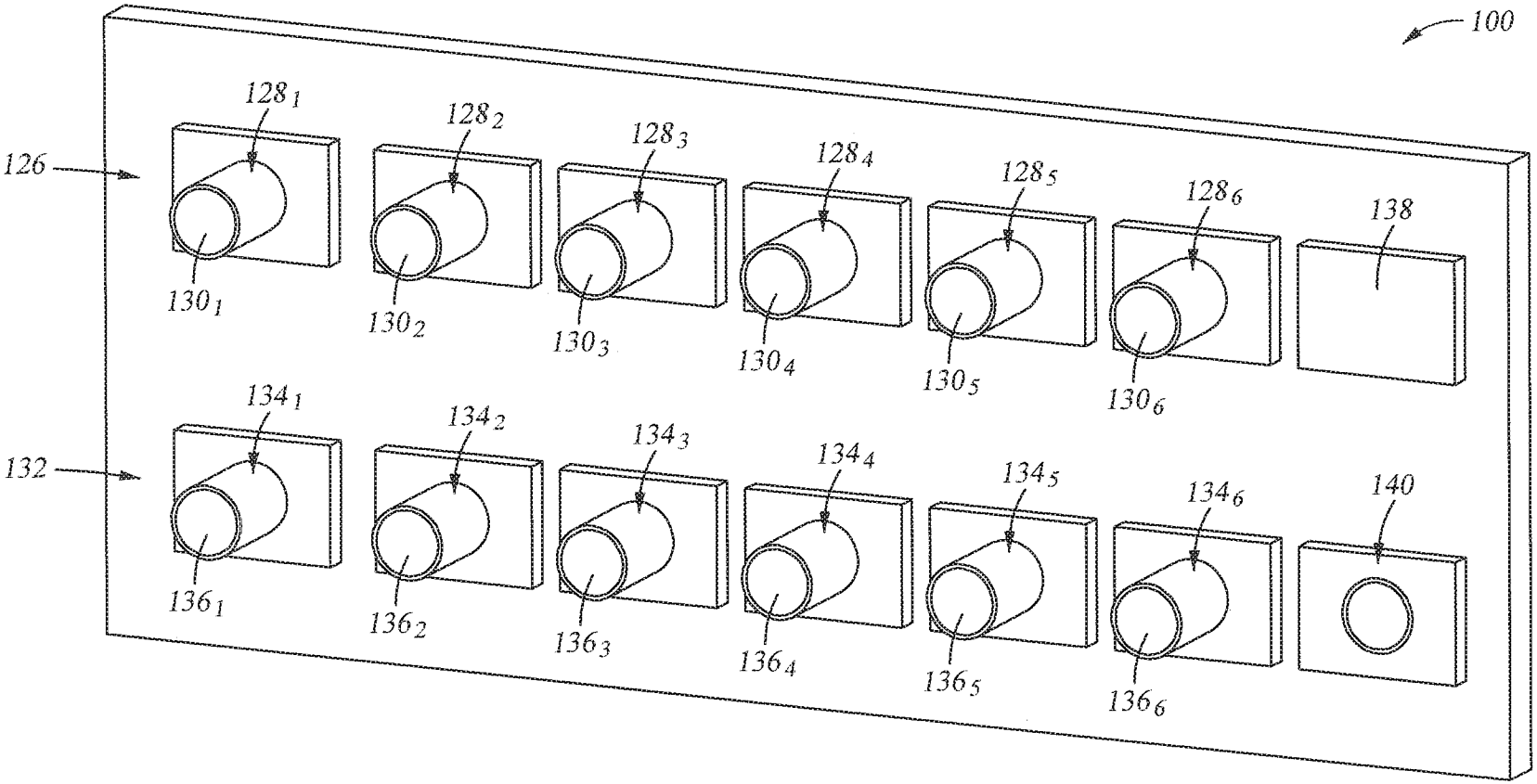
FIG. 4 is an end perspective views of an example of a junction box on the fracturing pump system of FIG. 2.

FIG. 4 shows an end perspective view of one example of junction box 100 which includes a row 126 of receptacles $\mathbf{128}_1$-$\mathbf{128}_6$, wherein the receptacles each have an opening $\mathbf{130}_1$-$\mathbf{130}_6$ on their ends distal from where they mount to junction box 100. Parallel with and set below row 126 is row 132, which is made up of a line of receptacles $\mathbf{134}_1$-$\mathbf{134}_6$ each having openings $\mathbf{136}_1$-$\mathbf{136}_6$. Also included with receptacle 100 is a ground connection 138 and an auxiliary/MCC connection 140. In another embodiment, the receptacles can be arranged in different patterns and configurations.

Figure 5:
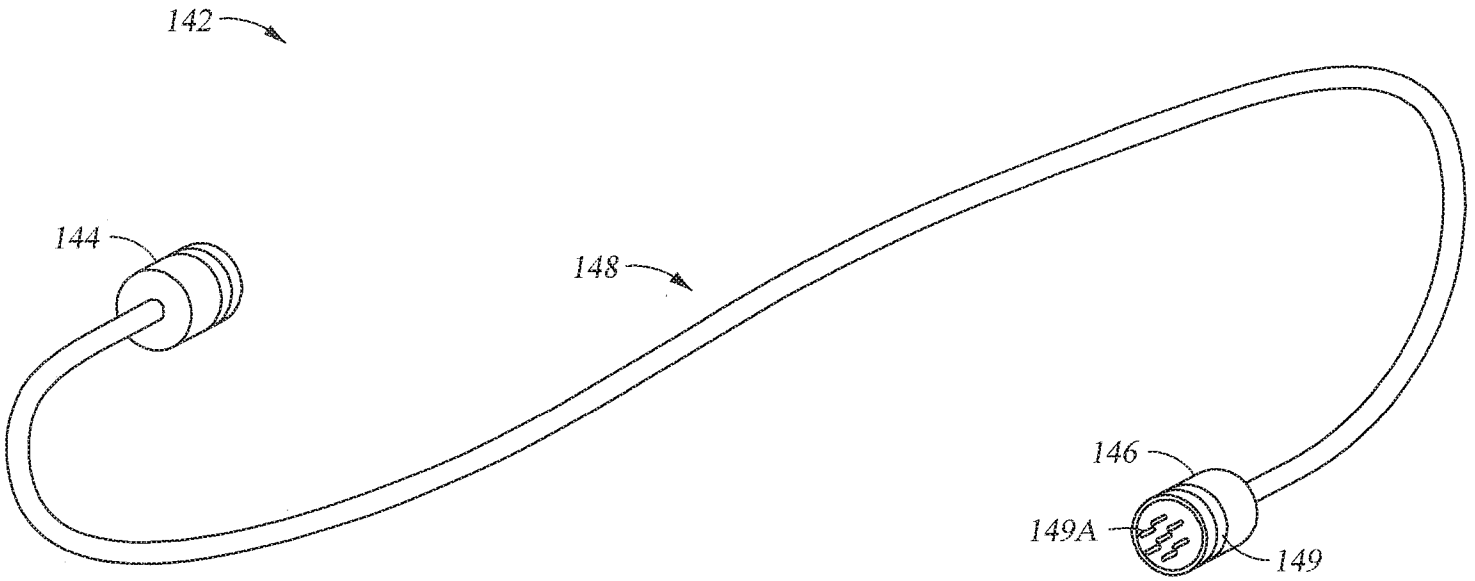
FIG. 5 is a side perspective view of an example of a cable assembly for use in electrical communication between the transformer and fracturing pump system of FIG. 2.

FIG. 5 shows in a side perspective view one example of a cable assembly 142 which includes plugs 144, 146 and a cable 148 extending between the plugs 144, 146 which provides electrical communication between plugs 144, 146. Plugs 144, 146 as shown each have an outer periphery configured so that plugs 144, 146 can be readily inserted into and removed from openings $\mathbf{114}_1$-$\mathbf{114}_6$, $\mathbf{120}_1$-$\mathbf{120}_6$, $\mathbf{130}_1$-$\mathbf{130}_6$, $\mathbf{136}_1$-$\mathbf{136}_6$. Optionally included with the plugs 144, 146 are electrodes 149 which are electrically conductive elements. Electrodes 149 are shown formed along the outer curved surface of plugs 144, 146 and can be recessed or inlayed on the surface of the plugs 144, 146 or can project radially outward. Alternate examples of electrodes 149A resemble planar prongs that project axially outward from the respective ends of plugs 144, 146 opposite from their connection to cable 148. When the plugs 144, 146 are inserted into a one of the receptacles $\mathbf{112}_1$-$\mathbf{112}_6$, $\mathbf{118}_1$-$\mathbf{118}_6$, $\mathbf{128}_1$-$\mathbf{128}_6$, $\mathbf{134}_1$-$\mathbf{134}_6$ of FIG. 3 or 4, the electrodes 149, 149A come into electrically conducting contact with corresponding electrodes (not shown) provided within the receptacles $\mathbf{112}_1$-$\mathbf{112}_6$, $\mathbf{118}_1$-$\mathbf{118}_6$, $\mathbf{128}_1$-$\mathbf{128}_6$, $\mathbf{134}_1$-$\mathbf{134}_6$; and thereby providing electrical communication one of the receptacles $\mathbf{112}_1$-$\mathbf{112}_6$, $\mathbf{118}_1$-$\mathbf{118}_6$ disposed injunction box 98 and one of the receptacles 1281-1286, 1341-1346 disposed injunction box 100.

Referring back to FIG. 2, line 150 is shown within fracturing pump system 36A and extending from a side of junction box 100 opposite from cable bundle 102 and connecting to motor 86. Accordingly, electrical communication between transformer 56 and motor 86 takes place from junction box 98, through cable bundle 102, to junction box 100, then to line 150. Although shown as a single line, line 150 can be made up of a plurality of electrically conducting elements such as lines or cables and may include a variable frequency drive. One specific example of forming cable bundle 102, six of the cable assemblies 142 are provided, and one of plugs 144, 146 are inserted into each of the openings $\mathbf{114}_1$-$\mathbf{114}_6$ of receptacles $\mathbf{112}_1$-$\mathbf{112}_6$. The other one of the plugs 144, 146 of cable assemblies 142 is then inserted into a corresponding opening $\mathbf{130}_1$-$\mathbf{130}_6$ of receptacles $\mathbf{128}_1$-$\mathbf{128}_6$. Thus in one example the six cable assemblies 142 extending between the receptacles $\mathbf{112}_1$-$\mathbf{112}_6$ to receptacles $\mathbf{128}_1$-$\mathbf{128}_6$ define cable bundle 102 for powering motor 86. An advantage of the cable assemblies 142 with insertable and removable plugs 144, 146 and receptacles $\mathbf{112}_1$-$\mathbf{112}_6$ and receptables $\mathbf{128}_1$-$\mathbf{128}_6$ is that the electrical communication between transformer 56 A and motor 86 can be assembled in a matter of minutes, versus the hours that has typically been required for hardwiring the electrical connection between the transformer 56A and motor 86. Similarly, cable bundle 104 is formed by providing six of the cable assemblies 142 and connecting them with the plugs 144, 146 into the receptacles $\mathbf{118}_1$-$\mathbf{118}_6$ and receptacles $\mathbf{134}_1$-$\mathbf{134}_6$. In similar fashion, a ground connection 108 between transformer 56A and fracturing pump system 36A is created by providing cable assembly 142 and inserting one of plugs 144, 146 into ground connection 122 and the other one of the plugs 144, 146 into ground connection 138. Optionally, simple bolt on lug attachments (not shown) can be used in lieu of the cable assemblies 142 for the ground connections 122, 138. Thus, while cable bundles 102, 104 each include six or more of the cable assemblies 142, example lines 106, 108 can include a single cable assembly 142. Alternatively, line 106 is made up of four internal conductors and have threaded end connections instead of the plugs. Optionally, cable bundles 102, 104 can be made up of less than six cable assemblies 142, or more than six cable assemblies 142.

In the example of FIG. 2 power to motors 84, 86 from transformer 56A is provided along separate and distinctive paths. A separate VFD may control and operate motor 84 while a second VFD controls and operates motor 86. An advantage of the separate and distinct paths of providing power to motors 84, 86 is that should power to one of motors 84, 86 be interrupted, power to the other one of the motors 84, 86 is not affected. More specifically, adjacent rows 110, 116 are not in communication with one another, adjacent rows 126, 132 are not in communication with one another; and adjacent cable bundles 102, 104 are not in communication with one another. Finally, lines 150, 152 are also separate and insulated from each other so that independent electrical paths are maintained for both the motors 84, 86. An additional advantage is provided by the dedicated ground line which plugs into ground connections 122, 138. The dedicated ground line may reduce voltage differential between equipment. In another embodiment, one VFD controls and operates one motor (either 84 or 86), which then controls both pump 80 and pump 82.

Figure 6:
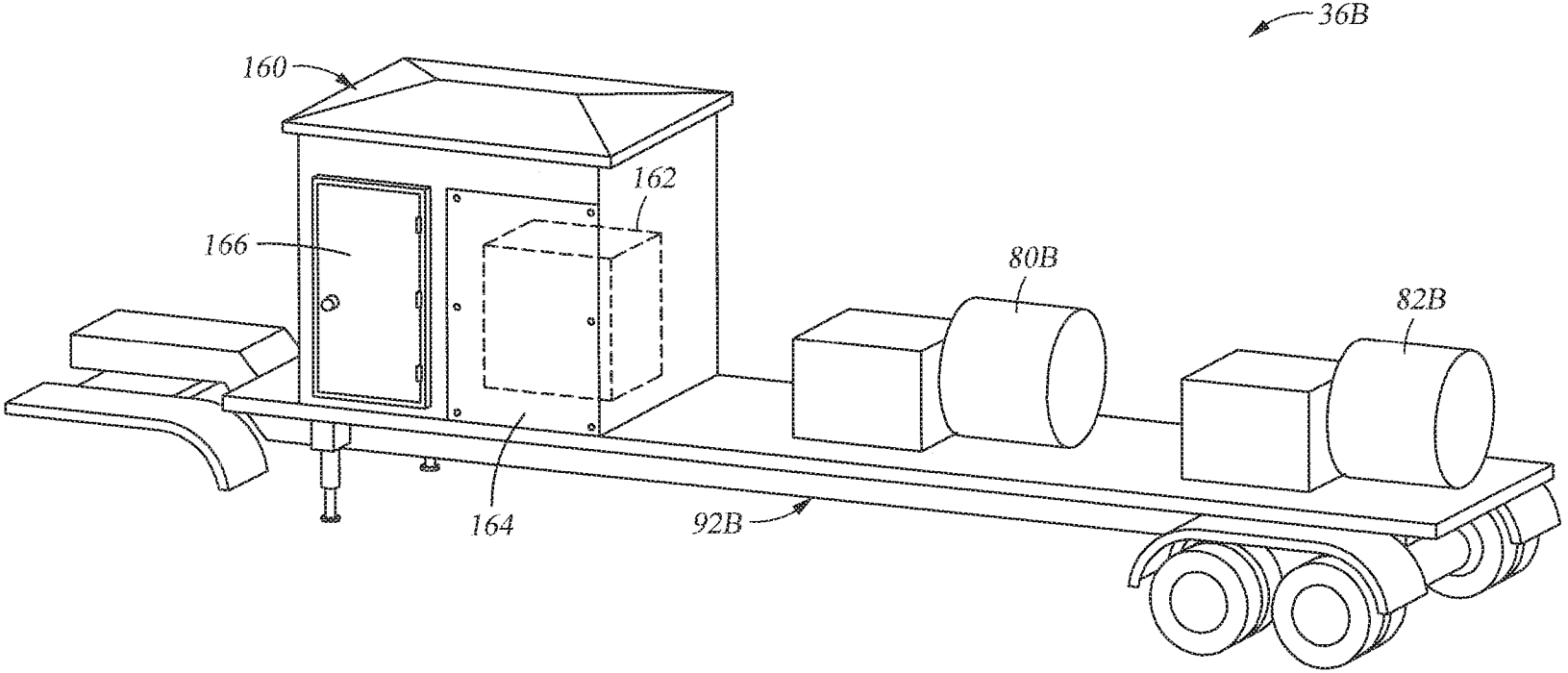
FIG. 6 is a side perspective view of an example of the fracturing pump system of FIG. 2.

FIG. 6 shows in a side perspective view one example of a fracturing pump system 36B mounted on trailer 92B. In this example, an end of trailer 92B distal from pumps 80B, 82B includes an enclosure 160 and inside of which is an example of a variable frequency drive 162 shown in a dashed outline. Adjacent variable frequency drive 162 a panel 164 is formed on enclosure 160, where panel 164 is readily removable from enclosure to give ready and full access to variable frequency drive 162. Panel 164 thus provides a way of quick and easy access for the repair, replacement, and/or maintenance of variable frequency drive 162. Also provided on enclosure 160 is a door 166 which allows access by operations personnel to inside of enclosure 160 to access and monitor various controls provided within enclosure 160. In one embodiment, the enclosure 160 includes two air conditioning units. Having two air conditioning units provides redundant cooling systems. Each air conditioning unit is capable of cooling both VFDs in the enclosure by itself should the other fail or need to be shut down for repair and maintenance.

Figure 7:
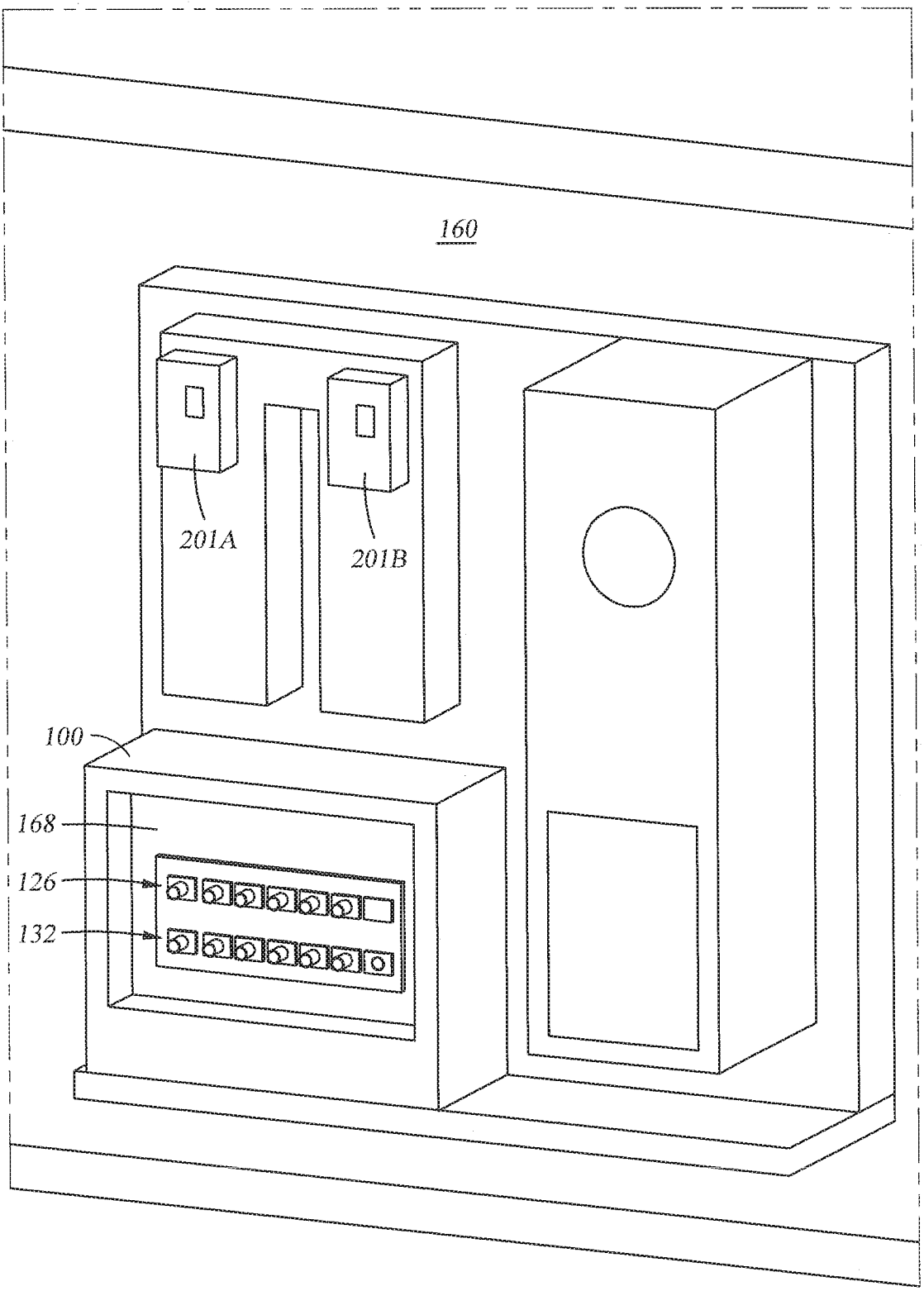
FIG. 7 is an end perspective view of the fracturing pump system of FIG. 6.

FIG. 7 shows an end perspective view of one example of enclosure 160, and wherein rows 126, 132 are provided in a recess 168 formed within junction box 100. Included in this example is an optional electric filter 201A in communication with the first VFD and motor 84 and a second electric filter 201B in communication with the second VFD and motor 86. Optionally, a second variable frequency drive (not shown) is provided within enclosure 160 and on a side opposite panel 164; a second panel (not shown) can be formed on enclosure to facilitate access to second variable frequency drive. In this example, each motor 80B, 82B is coupled with a dedicated variable frequency drive. In one embodiment, there is a second door for the enclosure providing a second, separate and distinct escape path from the enclosure. In one embodiment, the exit doors open outwards to allow for quick egress from the enclosure 160.

Referring back to FIGS. 3 and 4, the arrangement of the receptacles $\mathbf{112}_1$-$\mathbf{112}_6$, $\mathbf{118}_1$-$\mathbf{118}_6$, $\mathbf{128}_1$-$\mathbf{128}_6$, $\mathbf{134}_1$-$\mathbf{134}_6$ on junction boxes 98, 100 are generally mirror images of one another. Thus, when inserting one of plugs 144, 146 into receptacle $\mathbf{112}_1$, the corresponding receptacle, which is $\mathbf{128}_1$, will be aligned so that the cable assembly 142 can run along a generally straight path between junction boxes 98, 100 and without interfering with other cable assemblies 142 that connect into other receptacles. Moreover, in the illustrated example motors 84, 86 operate on three phase electricity, thus, in an alternative, the adjacent ones of receptacles transmit electricity that is at the same phase. For example, receptacles $\mathbf{112}_1$-$\mathbf{112}_2$ may transmit electricity at one phase, whereas receptacles $\mathbf{112}_3$, $\mathbf{112}_4$ transmit electricity at a different phase, and receptacles $\mathbf{112}_5$, $\mathbf{112}_6$ transmit electricity at yet another phase, wherein these different phases are approximately 120° apart. Further in this example, receptacles $\mathbf{128}_1$, $\mathbf{128}_2$ operate at one phase, wherein receptacles $\mathbf{128}_3$, $\mathbf{128}_4$ operate at another phase, and receptacles $\mathbf{128}_5$, $\mathbf{128}_6$ operate at a third phase. In one specific example, receptacles $\mathbf{112}_1$, $\mathbf{112}_2$ operate at the same phase as receptacles $\mathbf{128}_1$, $\mathbf{128}_2$, receptacles $\mathbf{112}_3$, $\mathbf{112}_4$ operated at the same phase as receptacles $\mathbf{128}_3$, $\mathbf{128}_4$, and receptacles $\mathbf{112}_5$, $\mathbf{112}_6$ operate at the same phase as receptacles $\mathbf{128}_5$, $\mathbf{128}_6$. By strategically forming a cable bundle 102, 104 made up of wires having dedicated phases, and allocating the same phase of electricity to cross more than one wire, a gauge of wire for the cable assemblies 142 can be formed which is manageable by operations personnel, which is another advantage of the present disclosure and which speeds the assembly and disassembly of the fracturing system 10.

Figure 8:
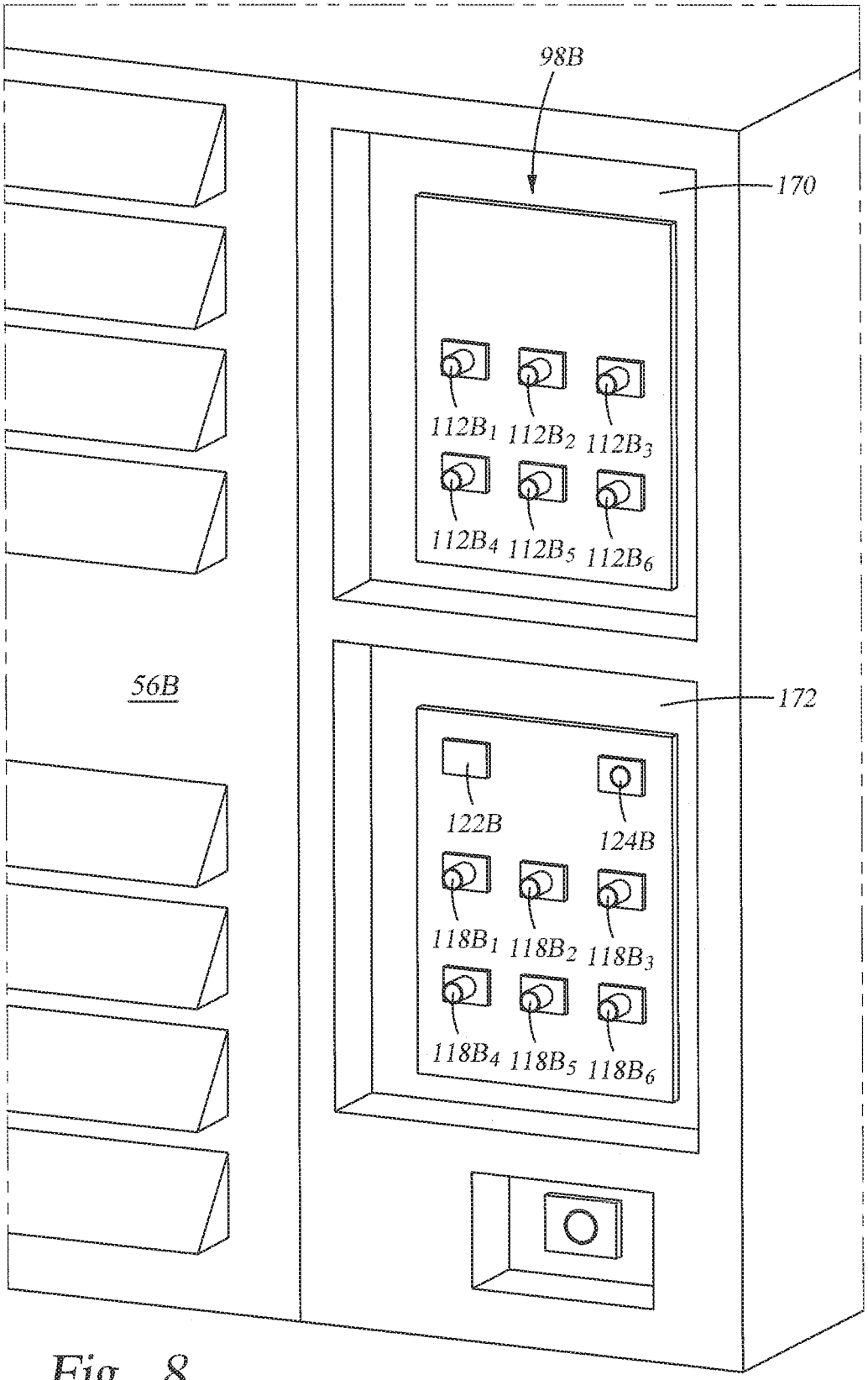
FIG. 8 is an end perspective view of an example of the transformer of FIG. 2.

FIG. 8 shows an end perspective view of an example of transformer 56B having recesses 170, 172 and with its sets of receptacles $\mathbf{112}B_1$-$\mathbf{112}B_6$ and $\mathbf{118}B_1$-$\mathbf{118}B_6$ each arranged in a pair of rows respectively in the recesses 170, 172. As shown, receptacles $\mathbf{112}B_1$-$\mathbf{112}B_6$ are arranged so that receptacles $\mathbf{112}B_1$ and $\mathbf{112}B_4$ are vertically aligned with one another, receptacles $\mathbf{112}B_2$ and $\mathbf{112}B_5$ are vertically aligned with one another, and receptacles $\mathbf{112}B_3$ and $\mathbf{112}B_6$ are vertically aligned with one another. In this example, receptacles $\mathbf{112}B_1$ and $\mathbf{112}B_4$ are in communication with electricity at a first phase, receptacles $\mathbf{112}B_2$ and $\mathbf{112}B_5$ are in communication with electricity at a second phase, and receptacles $\mathbf{112}B_3$ and $\mathbf{112}B_6$ are in communication with electricity at a third phase; where the first, second, and third phases are different, and can be about 120° apart from one another. Further illustrated are that receptacles $\mathbf{118}B_1$-$\mathbf{118}B_6$ in recess 172 are arranged so that receptacles $\mathbf{118}B_1$ and $\mathbf{118}B_4$ are vertically aligned with one another, receptacles $\mathbf{118}B_2$ and $\mathbf{118}B_5$ are vertically aligned with one another, and receptacles $\mathbf{118}B_3$ and $\mathbf{118}B_6$ are vertically aligned with one another. In this example, receptacles $\mathbf{118}B_1$ and $\mathbf{118}B_4$ are in communication with electricity at a first phase, receptacles $\mathbf{118}B_2$ and $\mathbf{118}B_5$ are in communication with electricity at a second phase, and receptacles $\mathbf{118}B_3$ and $\mathbf{118}B_6$ are in communication with electricity at a third phase; where the first, second, and third phases are different, and can be about 120° apart from one another. Additionally, ground connection 122B and auxiliary connection 124B are shown disposed in recess 172.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, other the recesses can be put into arrangements other than those described, such as all being in a vertical or other arrangement. These and other similar modifications will readily suggest themselves to those skilled in the art, and are intended to be encompassed within the spirit of the present invention disclosed herein and the scope of the appended claims.

What is claimed is:

1. A hydraulic fracturing system for fracturing a subterranean formation comprising:

first and second pumps;

first and second motors for driving the first and second pumps;

a transformer;

a first electrical circuit between the first motor and the transformer, and through which the first motor and transformer are in electrical communication; and a second electrical circuit that is separate and isolated from the first electrical circuit, and that is between the second motor and the transformer, and through which the second motor and transformer are in electrical communication;

wherein different phase electricity is transferred between the transformer and the first or second motors.

2. The hydraulic fracturing system of claim 1, further comprising a cable assembly having an electrically conducting cable, a transformer end plug on one end of the cable and in electrical communication with the cable, and a motor end plug on an end of the cable distal from the transformer end plug and that is in electrical communication with the cable.

3. The hydraulic fracturing system of claim 2, further comprising a transformer receptacle that is in electrical communication with the transformer, and a motor receptacle in electrical communication with a one of the first or second motors, so that when the transformer end plug is inserted into the transformer receptacle, and the motor end plug is inserted into the motor receptacle, the transformer and a one of the first or second motors are in electrical communication, and wherein the plugs are selectively withdrawn from the receptacles.

4. The hydraulic fracturing system of claim 3, further comprising a multiplicity of cable assemblies, transformer receptacles, and motor receptacles, wherein the different phase electricity transferred between the transformer and the first or second motors is transferred in different cables.

5. The hydraulic fracturing system of claim 4, wherein the receptacles are strategically arranged so that cable assemblies that conduct electricity at the same phase are adjacent one another.

6. The hydraulic fracturing system of claim 2, further comprising a transformer ground receptacle that is in electrical communication with a ground leg of the transformer, and a motor ground receptacle in electrical communication with a ground leg of one of the first or second pumps, so that when the transformer ground plug is inserted into the transformer ground receptacle, and the pump ground plug is inserted into the pump receptacle, the transformer ground leg and the ground leg of a one of the first or second pumps are in electrical communication, and wherein the plugs are selectively withdrawn from the receptacles.

7. The hydraulic fracturing system of claim 1, further comprising a platform on which the first and second pumps and motors are mounted, an enclosure on the platform, a variable frequency drive coupled with the motors and within the enclosure, and a removable panel on the enclosure adjacent the variable frequency drive, so that by removing the panel the variable frequency drive is accessible.

8. A hydraulic fracturing system for fracturing a subterranean formation comprising:

a source of electricity;

a row of source receptacles that are in electrical communication with the source of electricity;

an electrically powered motor that is spaced apart from the source of electricity;

a row of motor receptacles that are in electrical communication with the motor; and cable assemblies that each comprise, a source plug that is selectively insertable into a one of the source receptacles, a motor plug that is selectively insertable into a one of the motor receptacles, and a cable in electrical communication with both the source plug and motor plug, so that when the source plug inserts into a one of the source receptacles, and the motor plug inserts into the a one of the motor receptacles, electricity at a designated phase is transmitted from the source of electricity to the motor;

wherein electricity conducts from the source of electricity to the first motor along a first path, from the source of electricity to the second motor along a second path, and the first and second paths are separate and distinct from one another;

wherein some of the source receptacles receive electricity from the source of electricity at a phase that is different from a phase of electricity by other source receptacles from the source of the electricity.

9. The hydraulic fracturing system of claim 8, wherein the source of electricity comprises a transformer having alternating current electricity at three different phases.

10. The hydraulic fracturing system of claim 8, wherein the motor comprises a first motor, the system further comprising a second motor, and wherein the first and second motors each drive fracturing pumps.

11. The hydraulic fracturing system of claim 10, wherein the row of receptacles are configured so that some of the source receptacles receive electricity from the source of electricity at a phase that is different from a phase of electricity received by other source receptacles from the source of electricity.

12. The hydraulic fracturing system of claim 8, wherein a first pair of the source receptacles receive electricity at a first phase, so that a corresponding first pair of cable assemblies that have source plugs inserted into the source receptacles conduct electricity at the first phase, wherein a second pair of the source receptacles receive electricity at a second phase, so that a corresponding second pair of cable assemblies that have source plugs inserted into the source receptacles conduct electricity at the second phase, and wherein a third pair of the source receptacles receive electricity at a third phase, so that a corresponding third pair of cable assemblies that have source plugs inserted into the source receptacles conduct electricity at the third phase.

13. A method of hydraulic fracturing comprising:

a) electrically connecting a fracturing pump motor with a source of electricity by inserting a source end of a cable assembly into a source receptacle that is in electrical communication with the source of electricity and inserting a motor end of the cable assembly, which is in electrical communication with the source end of the cable assembly, into a motor receptacle that is in electrical communication with the fracturing pump motor, wherein the fracturing pump motor comprises a first fracturing pump motor and the cable assembly comprises a first cable assembly;

b) directing fracturing fluid to a suction end of a fracturing pump that is coupled with the fracturing pump motor;

c) causing the source of electricity to transmit electricity to the source receptacle, so that electricity conducts from the source receptacle, to the source and motor ends, to the motor receptacle, and to the motor; and d) pressurizing the fracturing fluid with the fracturing pump to form pressurized fracturing fluid, and directing the pressurized fracturing fluid to a wellbore;

e) repeating steps (a)-(c) using a second fracturing pump motor and a second cable assembly; wherein a path of electricity between the source of electricity and the first fracturing pump motor is separate and distinct from a path of electricity between the source of electricity and the second fracturing pump motor;

f) repeating step (a) so that multiple cable assemblies are connected between multiple source receptacles and multiple motor receptacles, so that electricity at different phases is conducted through the different cable assemblies to the fracturing pump motor.

14. The method of claim 13, wherein the source of electricity is a transformer that transmits 3-phase electricity.

15. The method of claim 13, further comprising removing the ends of the cable assembly from the receptacles, moving the source of electricity and fracturing pump motor to a different location, and repeating steps (a)-(c).

* * * * *